US006023997A

United States Patent [19]

Willis et al.

[11] Patent Number: 6,023,997

[45] Date of Patent: Feb. 15, 2000

[54] STRAIGHT LINE IMPACT HAMMER

[76] Inventors: Dane M. Willis, 8921 Lakeview Cir., Parma, Ohio 44129; Raymond Anzlovar, 22731 Overlook Dr., Euclid, Ohio 44117

[21] Appl. No.: 08/977,488

[22] Filed: Nov. 21, 1997

[51] Int. Cl.[7] ..... B25D 1/02

[52] U.S. Cl. ..... 81/25; 81/20; D8/80

[58] Field of Search ..... 81/20, 25, 26; D8/75, 78, 80; 173/90, 126, 128, 131

[56] References Cited

U.S. PATENT DOCUMENTS

| | | | |
|---|---|---|---|
| D. 185,675 | 7/1959 | MacMinn | D8/80 |
| D. 195,996 | 8/1963 | Caramelli | D8/78 |
| D. 282,523 | 2/1986 | Riemann | D8/80 |
| 1,122,506 | 12/1914 | Keating | 81/25 |
| 1,297,386 | 3/1919 | Michki | 81/26 |
| 2,808,561 | 10/1957 | Hughes | 81/25 |
| 3,211,198 | 10/1965 | Glasgow | 81/26 |
| 3,605,832 | 9/1971 | Stephens | 81/26 |
| 3,721,282 | 3/1973 | Hayes et al. | 81/26 |
| 3,821,973 | 7/1974 | Carmien | 81/25 |
| 4,520,997 | 6/1985 | Lorton, Sr. | 81/20 |
| 4,548,248 | 10/1985 | Riemann | 81/20 |

FOREIGN PATENT DOCUMENTS

| | | | |
|---|---|---|---|
| 2450148 | 10/1980 | France | 81/26 |
| 3126420 | 1/1983 | Germany | 81/25 |

*Primary Examiner*—David A. Scherbel
*Assistant Examiner*—Joni B. Danganan
*Attorney, Agent, or Firm*—Vytas R. Matas

[57] ABSTRACT

A straight line impact device is provided having a central grasping portion having finger and thumb indentations for either hand and being narrower than enlarged impact end areas having impact heads to thus provide a positive grip for a hand grasping the central area while also shielding the hand from slippage and missed impact on the impact areas. The enlarged portion is formed as a hexagon to prevent the rolling of the device and has replaceable impact heads of differing materials.

16 Claims, 2 Drawing Sheets

STRAIGHT LINE IMPACT HAMMER

BACKGROUND OF THE INVENTION

1. Field of the Invention

The present invention is generally drawn to impact tools such as hammers and more particularly to impact tools such as die beaters or babbits used in the tool and die industry.

2. Description of the Prior Art

Impact devices used in the tool and die industry are known as die beaters or babbits and comprise a solid bar approximately twelve inches long and three inches in diameter made from material softer than the die material on which it is impacted. Since most dies are made from 1020 steel, the usual materials for these bars are zinc, lead or steel since these materials are softer than 1020 steel but still have a high density and provide the needed weight for a driving force sufficient to open the die.

Since certain dies are made from softer materials than 1020 steel such as aluminum or even wood, other materials are needed for the impact bars. These materials include rubber, plastic and even canvas or rawhide covers for the impact surfaces of the die beaters.

The die beater is commonly used to take the die set apart and put it together. Hitting the die causes it to slide in and out and also to press fit different items in place. Hitting parts around is needed to true up or position them in correct places and to set up and dismantle projects. In all applications it is important not to mar or damage the item being hit, thus the use of soft beaters is required.

In any event, whatever the material is used for the die beater, using same is neither safe, practical nor easy. Anyone who has used this tool for any length of time has smashed his/her hand or fingers more than once. When the hand slips up or down on the bar a cut upon one's hand from the inaccurate hit to the item being worked on results. Hitting the bar with a hammer may cause one to miss the bar top causing a scrape of the hand holding the bar. Also, setting the round bar down on a bench or other working surface may cause the bar to roll off causing injury or damage.

There are no die beaters which provide a shield for the hand holding the beater nor any firm grip for same. Also, if a different softer material is needed for a particular die a different die beater is required.

Replaceable hammer ends are known and they are described in U.S. Pat. Nos. 850,024 and 3,019,827 but there is no teachings therein on how this could be adapted to a die beater.

Hand grips for hammer handles are also known and one such is shown in U.S. Pat. No. 1,297,388. However, there is no teaching therein on how this could be adapted to a die beater so that either end of same could be used as an impact surface.

There is no teachings in the known prior art which would disclose a die beater having a hand shield to protect it from impact on the ends and which would provide a firm hand hold in the middle of the beater allowing a grasp with either hand as well as providing replaceable impact heads to both sides and having means for preventing the die beater from rolling off flat surfaces.

BRIEF SUMMARY OF THE INVENTION

The present invention solves the mentioned problems associated with prior art devices as well as others by providing a die beater having a hand shield to protect it from impact on the ends and which would provide a firm hand hold in the middle of the beater allowing a grasp with either hand as well as providing replaceable impact heads to both sides and having provisions for preventing the die beater from rolling off flat surfaces.

To provide the above, a die beater of suitable material is made to have a thinner central portion having finger indentations on one side and a pair of thumb indentations on the other side to allow the grasping of the beater with either hand. The end or impact portions are enlarged to protect the hand holding the central portion and are formed with flat portions thereon to prevent the die beater from rolling off a flat surface.

In one embodiment replaceable impact heads are provided of differing materials allowing the use of the same die beater on different hardness dies.

In view of the foregoing it will be seen that one aspect of the present invention is to provide a die beater having a central hand grip for either hand.

Another aspect of the present invention is to provide a shield for the hand holding the beater bar.

Yet another aspect is to provide a positive means for preventing the rolling of the die beater on a flat surface.

Still yet another aspect of the invention is to provide a die beater with replaceable impact heads.

These and other aspects of the invention will be more fully understood upon a review of the following description of the preferred embodiment when considered with the accompanying drawings.

DESCRIPTION OF THE PREFERRED EMBODIMENT

Figure 1:
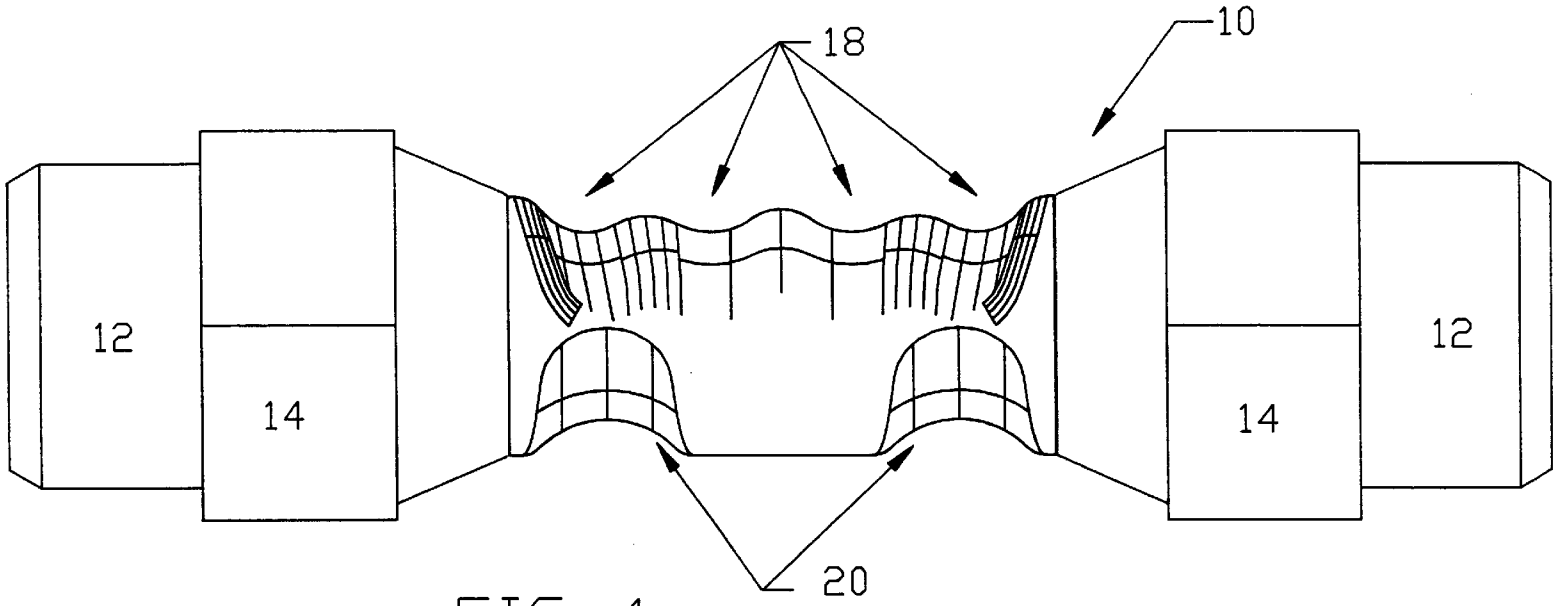
FIG. 1 is a side view of one embodiment of the die beater of the present invention.
Figure 2:
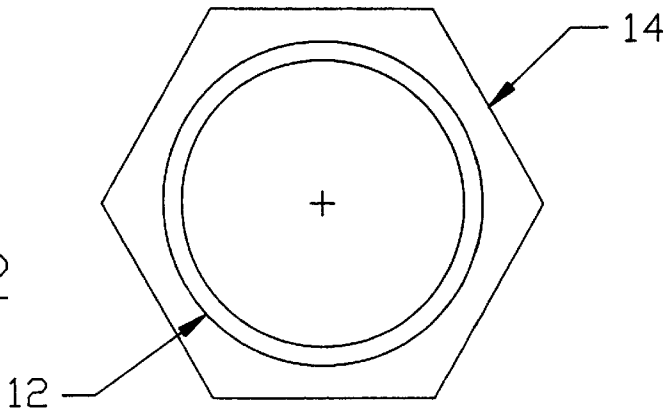
FIG. 2 is an end view of the FIG. 1 embodiment.

Referring now to the drawings where the showings are to illustrate preferred embodiments of the invention and not to limit the invention to same, FIGS. 1–2 show one embodiment of a die beater assembly (10). The die beater (10) is a one piece construction formed from the universally most compatible material used for die beaters namely zinc and is of a size and weight used for same. Generally, the die beater device is formed from material from the group comprising zinc, steel, and materials other than zinc or steel but having a density comparable to zinc and steel to function in a similar manner as a die beater.

However, the size and weight will vary, for other applications or uses for this product such as the machine trades, mold making and form plastic and die cast machine builders and repair and maintenance of all sorts as well as the construction fields. This tool is especially useful for use in tight places, plumbing, brick, ironwork, welding, and carpentry.

The beater (10) is formed to have circular end impact heads (12) extending from hexagonal enlarged end sections (14) leading to a thin central portion (16). The beater (10) is held by either hand around this central portion and may be used to impact either impact head (12) upon a die or other impact surface. It also may be used in combination with a hammer by placing one impact head on an impact surface and hitting the other with a hammer. No matter what the use, the thinner control portion (16) around which the fingers are circled is protected from hammer impacts and slippage by the enlarged hexagonal end section (14). The end sections are made hexagonal to prevent the die beater from rolling off a flat surface such as a work bench to be either lost or to fall on something fragile causing damage thereto.

To provide a secure hand hold to the die beater, a series of four finger indentations (18) are formed in one end of the central portion (16) while a pair of thumb indentations (20) are formed on an end opposite the finger indentations (18). Since the thumb is offset from the form fingers of the hand, the four finger indentations (18) and two thumb indentations (20) allow the beater (10) to be easily grasped by either hand. This allows for the use by either left or right handed people as well as the switching of hands during prolonged work sessions tiring one hand.

Figure 3:
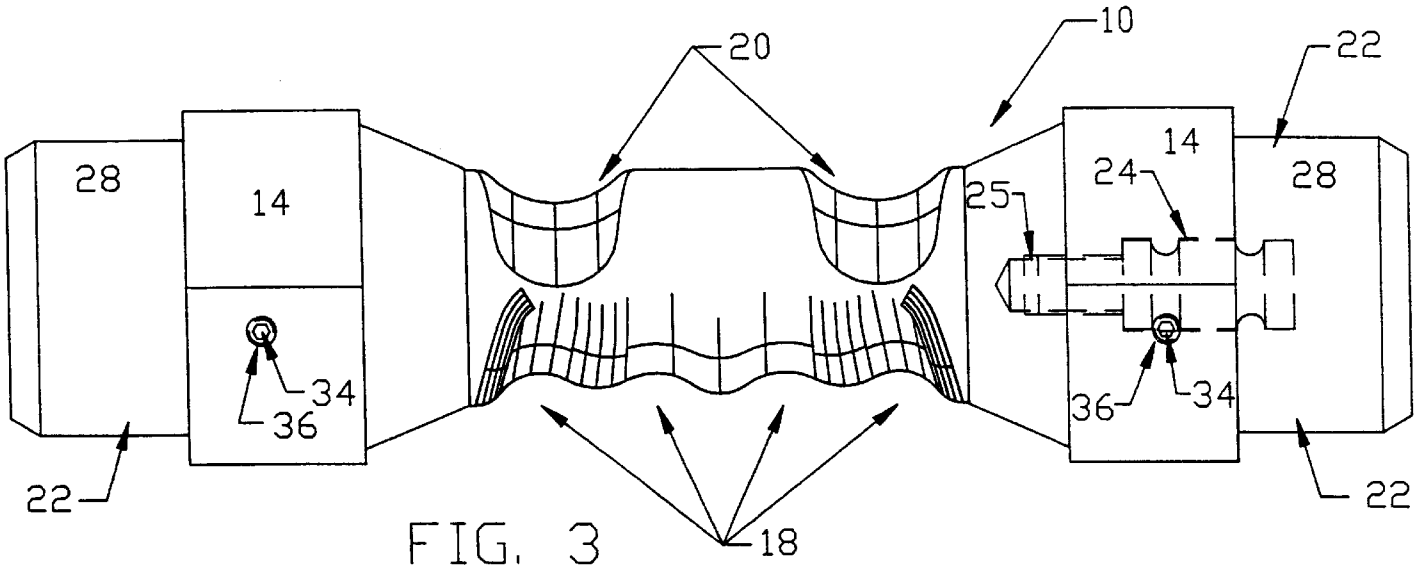
FIG. 3 is a side view of a second embodiment of the die beater of the present invention with a internal showing of a replaceable tip mounted on the right end of same.
Figure 5:
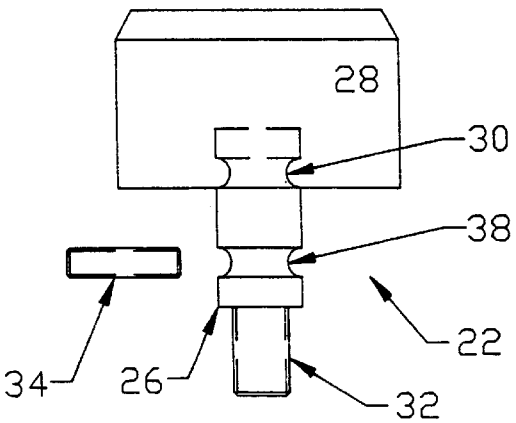
FIG. 5 is an expanded view of the replaceable tip shown in FIG. 3.
Figure 4:
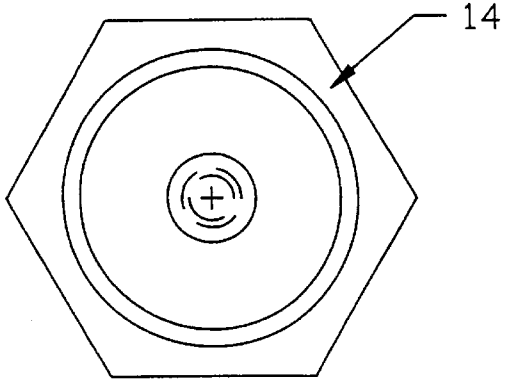
FIG. 4 is an end view of the FIG. 3 embodiment.

Referring now to FIGS. 3–5 a second embodiment of the present invention is disclosed wherein the die beater (10) is made to have a removable and replaceable impact head assembly (22). It will be understood that elements common to the FIGS. 1–2 embodiment have the same numbering and are identical in form and function thereto.

To provide replaceable impact heads, for the beater (10) the impact heads (12) are replaced with the assembly (22) formed in both ends of the beater (10) having a narrower threaded section (25) extending therein.

The replaceable impact head assembly (22) is formed to have a steel shaft assembly (26) around the top of which is cast an impact head (28) of different material for different applications. The shaft assembly (26) has an annular undercut (30) around which the cast material is formed to prevent the shaft assembly (26) from pulling out of the impact head (28). The end of the shaft assembly (26) has a threaded shaft (32) with threads complimentary to the threads in the opening (25) extending from the enlarged opening (24).

When an impact head is needed of differing material, the old head (28) is removed and the new head is inserted by threading the shaft (32) of the new head (28) into the threaded opening (25) of the beater (10). To secure the new impact head to the beater (10) an allen head screw (34) is threaded through a threaded opening (36) formed in the hexagonal portion (14) of the beater (10) until it fits into an annular portion (38) formed above the threaded portion (32) of the shaft assembly (26). This effectively locks the impact head (28) to the beater (10). Since both ends of the beater (10) are replaceable different impact head materials may be mounted on opposite ends of the beater (10) which are also different from the rest of the beater (10) which is usually zinc. Thus the impact area and central area of the beater (10) may be formed from zinc while the impact tips formed from metal or plastic.

Certain improvements additions and modifications will be obvious to people of ordinary skill in this area. It will be understood that all such have been deleted herein for the sake of conciseness and readability but are properly within the scope of the following claims.

What is claimed is:

1. A straight line impact device comprising:

impact surface areas having end-located impact surfaces at opposite ends of the device;

a centrally located hand holding area formed in a straight line alignment with said opposite impact surface areas;

said centrally located hand holding area being narrower than said impact surface areas to allow said impact surface areas to offer protection for the hand holding area; and including a series of depressions located exclusively on one side of said central area to provide finger holds along with a first and a second thumb depression located in said central area exclusively on a side of said central area opposite said finger hold depressions to provide a hand hold of the device by either hand.

2. An impact device as set forth in claim 1 wherein said impact surface areas are formed as hexagons to prevent rolling of the device.

3. An impact device as set forth in claim 2 wherein said impact surface areas have a circular impact end extending from said hexagonal impact area.

4. An impact device as set forth in claim 1 wherein said impact surface areas and said central area are formed as a single unit made from material from the group comprising Zinc, Steel.

5. A straight line impact device having end-located impact areas and a centrally located hand holding area comprising;

said end located impact areas and said centrally located holding area being formed in a straight line alignment with each other;

a removable impact tip at the end of each impact area;

said impact areas and said central area being formed from a first material and at least one of said removable impact tips being formed from a second material different from said first material; and removable means for retaining said removable impact tips to said impact area.

6. A straight line impact device as set forth in claim 5 wherein said first material is zinc and said second material is metal.

7. A straight line impact device as set forth in claim 5 wherein said first material is zinc and said second material is plastic.

8. A straight line impact device as set forth in claim 5 including a series of depressions located in said central area to provide finger holds.

9. A straight line impact device as set forth in claim 8 including a thumb depression located in said central area opposite said finger hold depressions.

10. A straight line impact device as set forth in claim 9 including a second thumb depression located in said central area opposite said finger hold depressions to provide a hand hold of the device by either hand.

11. A straight line impact device as set forth in claim 10 wherein said impact surface areas have a flat area to prevent rolling of the device.

12. A straight line impact device as set forth in claim 9 wherein said impact surface areas are formed as hexagons to prevent rolling of the device.

13. A straight line impact device as set forth in claim 12 wherein said impact tips are formed to have a circular impact end which extends from said hexagonal impact area when said impact tips are threaded into said impact area.

14. A straight line impact device comprising;

impact surface areas having end-located impact surfaces at opposite ends of the device;

a centrally located hand holding area formed in a straight line with said opposite impact surface areas;

said centrally located hand holding area being narrower than said impact surface areas to allow said impact surface areas to offer protection for the hand holding area; and wherein said impact surface areas have a flat area to prevent the rolling off of the device from any flat surface the device may be placed on.

15. A straight line impact device having end-located impact areas and a centrally located hand holding area comprising;

a removable impact tip at the end of each impact area;

said impact areas and said central area being formed from a first material and at least one of said removable impact tips being formed from a second material different from said first material;

removable means for retaining said removable impact tips to said impact area wherein said impact areas have a threaded end-located aperture and wherein said impact tips are formed to have an impact head with a threaded shaft extending therefrom for threading into said aperture; and including a pin extending through an annular portion of said shaft of said impact tip from said impact head area to retain said impact tip to said impact head area.

16. A straight line impact device as set forth in claim 15 wherein a portion of said shaft which extends into said impact end has an annular groove formed thereon to allow the impact end to form into said groove to securely lock the shaft thereto.

* * * * *